US011001768B2

(12) United States Patent
Liu et al.

(10) Patent No.: US 11,001,768 B2
(45) Date of Patent: May 11, 2021

(54) HEAVY OIL HYDROTREATING SYSTEM AND HEAVY OIL HYDROTREATING METHOD

(71) Applicants: China Petroleum & Chemical Corporation, Beijing (CN); Fushun Research Institute of Petroleum and Petrochemicals, Sinopec Corp., Liaoning (CN)

(72) Inventors: Tiebin Liu, Liaoning (CN); Xinguo Geng, Liaoning (CN); Yanbo Weng, Liaoning (CN); Hongguang Li, Liaoning (CN)

(73) Assignees: CHINA PETROLEUM & CHEMICAL CORPORATION, Beijing (CN); FUSHUN RESEARCH INSTITUTE OF PETROLEUM AND PETROCHEMICALS, SINOPEC CORP., Liaoning (CN)

( * ) Notice: Subject to any disclaimer, the term of this patent is extended or adjusted under 35 U.S.C. 154(b) by 223 days.

(21) Appl. No.: 15/775,694

(22) PCT Filed: Nov. 1, 2016

(86) PCT No.: PCT/CN2016/104206
§ 371 (c)(1),
(2) Date: May 11, 2018

(87) PCT Pub. No.: WO2017/080387
PCT Pub. Date: May 18, 2017

(65) Prior Publication Data

US 2018/0346828 A1 Dec. 6, 2018

(30) Foreign Application Priority Data

Nov. 12, 2015 (CN) ..... 201510769160.7

(51) Int. Cl.
*C10G 65/08* (2006.01)
*C10G 65/14* (2006.01)
*C10G 65/00* (2006.01)
*C10G 45/72* (2006.01)

(52) U.S. Cl.
CPC ..... *C10G 65/08* (2013.01); *C10G 45/72* (2013.01); *C10G 65/00* (2013.01)

(58) Field of Classification Search
CPC ..... C10G 65/08; C10G 65/00; C10G 65/02; C10G 65/14; C10G 47/72
See application file for complete search history.

(56) References Cited

U.S. PATENT DOCUMENTS 3,972,686 A * 8/1976 Johnson ..... B01J 8/002 422/219
4,017,382 A * 4/1977 Bonnell ..... C10G 49/002 208/210

(Continued)

FOREIGN PATENT DOCUMENTS

CN 1393515 A 1/2003
CN 101768468 A 7/2010

(Continued)

OTHER PUBLICATIONS

Tiebin Liu et al., "Study on the Integrate Process of Residue Hydrotreating and FCC", Contemporary Chemical Industry, vol. 41, No. 6, Jun. 2012, pp. 582-584.

*Primary Examiner* — Michelle Stein
(74) *Attorney, Agent, or Firm* — Novick, Kim & Lee, PLLC; Allen Xue

(57) ABSTRACT

A heavy oil hydrotreating system has a prehydrotreating reaction zone, a transition reaction zone, and a hydrotreating reaction zone that are connected in series successively, sensor units, and a control unit. In the initial reaction stage, the prehydrotreating reaction zone includes at least two prehydrotreating reactors connected in parallel, and the (Continued)

transition reaction zone includes or doesn't include prehydrotreating reactors; in the reaction process, the control unit controls material feeding to and material discharging from each prehydrotreating reactor in the prehydrotreating reaction zone according to pressure drop signals of the sensor units, so that when the pressure drop in any of the prehydrotreating reactors in the prehydrotreating reaction zone reaches a predetermined value, the prehydrotreating reactor in which the pressure drop reaches the predetermined value is switched from the prehydrotreating reaction zone to the transition reaction zone.

13 Claims, 1 Drawing Sheet

(56) References Cited

U.S. PATENT DOCUMENTS

| | | | | |
|---|---|---|---|---|
| 5,472,928 | A | 12/1995 | Scheuerman et al. | |
| 5,968,347 | A * | 10/1999 | Kolodziej | C10G 65/04 208/210 |
| 6,447,671 | B1 | 9/2002 | Morel et al. | |
| 8,696,888 | B2 | 4/2014 | Keusenkothen et al. | |
| 2009/0139902 | A1 | 6/2009 | Kressmann et al. | |
| 2011/0073523 | A1 | 3/2011 | Cui et al. | |
| 2014/0027351 | A1 * | 1/2014 | Bazer-Bachi | C10G 65/00 208/211 |
| 2014/0299515 | A1 | 10/2014 | Weiss et al. | |

FOREIGN PATENT DOCUMENTS

| | | | |
|---|---|---|---|
| CN | 102041065 | A | 5/2011 |
| CN | 102041095 | A | 5/2011 |
| CN | 102311786 | A | 1/2012 |
| CN | 102311786 | A * | 1/2012 |
| CN | 102453530 | A | 5/2012 |
| CN | 102676218 | A | 9/2012 |
| CN | 103059928 | A | 4/2013 |
| CN | 103059931 | A | 4/2013 |
| CN | 103540349 | A | 1/2014 |
| CN | 104119954 | A | 10/2014 |
| RU | 2134286 | C1 | 8/1999 |
| WO | 2013057389 | A1 | 4/2013 |

* cited by examiner

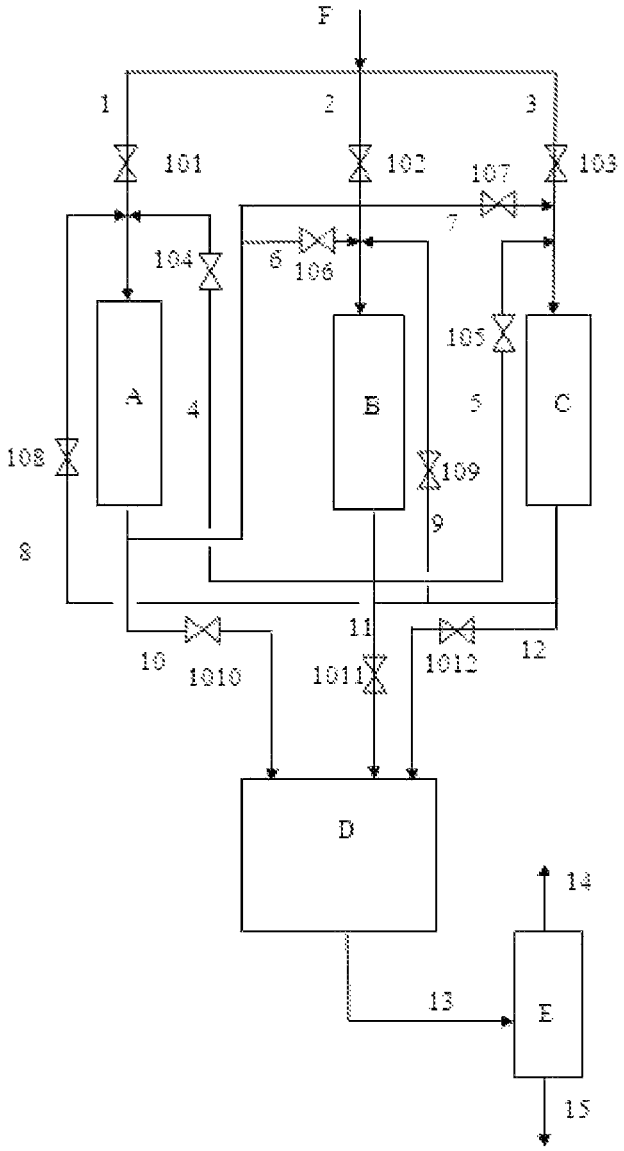
F
1
2
3
101
102
103
107
7
104
6
106
105
A
4
B
5
C
108
109
9
8
11
10
1010
1011
1012
12
D
14
13
E
15

HEAVY OIL HYDROTREATING SYSTEM AND HEAVY OIL HYDROTREATING METHOD

FIELD OF THE INVENTION

The present invention relates to the field of heavy oil hydrotreatment, in particular to a heavy oil hydrotreating system and a heavy oil hydrotreating method.

BACKGROUND OF THE INVENTION

At present, the demand for oil products, including gasoline, kerosene and diesel oil, especially motor gasoline, in the oil product markets in China and foreign countries, still tends to increase continuously, while the demand for heavy oil products such as heavy fuel oil tends to decrease. At the same time, the properties of crude oil become worse increasingly, but the environmental laws and regulations become stringent increasingly around the world, putting forth increasingly strict requirements for the quality of oil products. Therefore, how to convert heavy oil products into light oil products and upgrade the quality of gasoline and diesel oil products economically at reasonable costs has become a focus of attention in the oil refining industry in China and foreign countries.

The main purpose of heavy oil hydrogenation processes (e.g., residual oil hydrogenation processes) is to greatly decrease the contents of impurities in the residual oil raw material, including sulfur, nitrogen, and metals, etc., through hydro-treatment, convert the non-ideal components in the residual oil raw material, such as condensed aromatics, resin and asphaltene, etc., by hydrogenation, improve the hydrogen-carbon ratio, reduce the content of residual carbon, and significantly improve the cracking performance. The fixed bed residual oil hydrogenation technique is a heavy oil deep processing technique. With the technique, in a fixed bed-type reactor that contains specific catalysts, atmospheric or vacuum residual oil is processed by desulphurization, denitrification, and demetalization, etc., at high temperature and high pressure in the presence of hydrogen, to obtain light oil products as far as possible. The technique is one of important means for converting residual oil into light oil products. The fixed bed residual oil hydrogenation technique is applied more and more widely, owing to its advantages including high yield of liquid product, high product quality, high flexibility of production, less waste, environment friendliness, and high rate of return on investment, etc.

In the existing fixed bed heavy oil hydrotreating process, all reactors are usually connected in series. Therefore, a large quantity of guard catalyst has to be loaded in the first reactor to cause the impurities and scale in the raw material to deposit. Such an operation may cause compromised overall metal compound removing and containing capability of the catalyst because the pressure drop in the reactors is still low in the final stage of operation of the apparatus in some cases owing to low activity and low demetalization load of the catalyst system charged in the first guard reactor. If the catalyst activity is increased, the pressure drop will be increased quickly and the running period will be shortened, but the catalyst performance hasn't been given full play; therefore, it will be difficult to maintain appropriate activity of the catalyst in the first guard reactor. Moreover, there are many factors that must be considered in the entire operation process of the heavy oil hydrogenation apparatus, such as emergent state/stop, fluctuation of properties of the raw material, or sudden increased contents of impurities (e.g., Fe, Ca) in the raw material, etc. Therefore, a common practice is to maintain the catalyst in the first guard reactor in a low reaction activity state, mainly for the purpose of intercepting and depositing the impurities and scale in the raw material and maintaining the demetalization reaction at a low rate; usually, the reaction temperature rise in the reactor is low, and the pressure drop is kept at a low level in the entire running period. To that end, a large quantity of demetalization catalyst has to be charged in the follow-up demetalization reactor mainly for promoting the demetalization reaction and providing enough space for accommodating the metal compound and carbon deposit removed in the hydrogenation. As a result, a great deal of metal is deposited in the demetalization reactor inevitably, and the load of demetalization reaction is high. Usually, the reaction temperature rise in that reactor is the highest. Though the pressure drop in that reactor is low in the early stage, the pressure drop in that reactor is increased first and increased at the highest rate among the reactors in the middle stage or final stage. That fact becomes a major factor that has adverse influences on the running period and stable operation of the apparatus. The patent document CN103059928A has disclosed a hydrotreating apparatus, an application of the hydrotreating apparatus, and a residual oil hydrotreating method. The invention described in the patent document provides a hydrotreating apparatus, which comprises a hydrogenation guard unit and a main hydrotreating unit connected in series successively, the hydrogenation guard unit comprises a main hydrogenation guard reactor and a standby hydrogenation guard reactor, and the volume of the main hydrogenation guard reactor is greater than the volume of the standby hydrogenation guard reactor. In the hydrotreating process, the main hydrogenation guard reactor and the standby hydrogenation guard reactor are used in alternate. The process utilizes the main hydrogenation guard reactor and the standby hydrogenation guard reactor in alternate and can treat residual oil with high calcium content and high metal content, but has a drawback that a reactor is kept in idle state, which causes increased investment and decreased utilization ratio of the reactors; in addition, the problem of increased pressure drop in the lead reactor can't be solved radically.

The patent document CN1393515A has disclosed a residual oil hydrotreating method. In the method, one or more feed inlets are added on the first reactor in the heavy residual oil hydrogenation reaction system, and the original catalyst grading is changed. The next feed inlet is used whenever the pressure drop in the catalytic bed in the first reactor reaches 0.4-0.8 time of the design pressure drop of the apparatus, and the feed inlet that is used originally may be used to feed recycle oil or mixed oil of recycle oil and raw oil. The process can effectively prevent pressure drop in the bed layers and prolong the running period of the apparatus, can increase the processing capacity of the apparatus, and is helpful for improving material circulation and distribution. However, the process has drawbacks such as increased manufacturing cost of reactors, increased initial pressure drop, and lowered utilization ratio of reactor volume.

The patent document CN103059931A has disclosed a residual oil hydrotreating method. In that method, under hydrotreating reaction conditions, the residual oil raw material and hydrogen flow through several reactors connected in series successively; offload operation is performed after the apparatus operates for 700-4,000 h, specifically, the feed rate of the first reactor is decreased or kept unchanged, the feed rate of the reactors between the first reactor and the last reactor is increased, and the increased residual oil raw material is fed via the inlets of the middle reactors. The method alleviates the increase of pressure drop by changing the feed loads of the reactors, but can't change the increase tendency of pressure drop in the lead reactor radically. Viewed from the result of actual industrial operation, the pressure drop will reach a design upper limit quickly once it is increased; moreover, changing the feed rates at the inlets of the reactors is adverse to stable operation of the apparatus.

The patent document CN102676218A has disclosed a fixed bed residual oil hydrogenation process, which comprises the following steps: (1) feeding a mixture of raw oil and hydrogen into a first fixed bed-type reactor, and controlling the mixture to contact with a hydrogenation catalyst for hydrogenation reaction; (2) feeding the mixture of raw oil and hydrogen into the first fixed bed-type reactor and a standby first fixed bed-type reactor when the pressure drop in the first fixed bed-type reactor is increased to 0.2-0.8 MPa, and feeding the resultant of reaction into follow-up hydrogenation reactors. In that process, the first fixed bed-type reactor and the standby first fixed bed-type reactor may be connected in parallel or in series, or configured in a way that one reactor is used separately while the other reactor is kept in a standby state. However, the drawbacks include: the utilization ratio of the reactors is degraded since a reactor is kept in idle state in the initial stage, and the problem of increase of pressure drop in the lead reactor can't be solved radically.

The patent document CN103540349A has disclosed a combined poor heavy oil and residual oil hydrotreating process, which comprises: prehydrotreating heavy oil and/or residual oil raw material in a slurry bed reactor, separating the gas phase from the liquid phase, and then hydro-upgrading the liquid phase product in a fixed bed, wherein, the slurry bed prehydrotreating portion includes a slurry bed hydrogenation reactor and a slurry bed hydrogenation catalyst; the reactors used in the fixed bed hydro-upgrading portion mainly include the following reactors in sequence: two up-flow-type deferrate and decalcification reactors, an up-flow-type demutualization reactor, a fixed bed desulfurization reactor, and a fixed bed denitrification reactor, wherein, the two up-flow-type deferrate and decalcification reactors may be connected in series or in parallel, or configured in a way that one reactor is used separately while the other reactor is kept in a standby state. However, the process has drawbacks such as mismatching among the running periods of the stages, high investment, and high operation difficulties.

CONTENTS OF THE INVENTION

The purpose of the present invention is to overcome the problem that the existing heavy oil hydrotreating method cannot fundamentally solve the problem of reactor pressure drop increase, thereby affecting the running period and stability of the apparatus, the present invention provides a heavy oil hydrotreating system and a heavy oil hydrotreating method. The method provided in the present invention employs a simple process flow, and can greatly prolong the running period of a heavy oil hydrotreating apparatus and maximize the utilization efficiency of catalyst, simply by making simple improvements to the existing apparatus.

The present invention provides a heavy oil hydrotreating system, which comprises a prehydrotreating reaction zone, a transition reaction zone, and a hydrotreating reaction zone that are connected in series, and sensor units and a control unit, wherein, the sensor units are configured to detect pressure drop in each prehydrotreating reactor in the prehydrotreating reaction zone, and the control unit is configured to receive pressure drop signals from the sensor units;

In the initial reaction stage, the prehydrotreating reaction zone includes at least two prehydrotreating reactors connected in parallel, and the transition reaction zone includes or doesn't include prehydrotreating reactors;

In the reaction process, the control unit controls material feeding to and material discharging from each prehydrotreating reactor in the prehydrotreating reaction zone according to pressure drop signals of the sensor units, so that when the pressure drop in any of the prehydrotreating reactors in the prehydrotreating reaction zone reaches a predetermined value, the prehydrotreating reactor in which the pressure drop reaches the predetermined value is switched from the prehydrotreating reaction zone to the transition reaction zone.

In the heavy oil hydrotreating system described in the present invention, the predetermined value of pressure drop in the prehydrotreating reactor is 50%-80% of a design upper limit of pressure drop for the prehydrotreating reactors, preferably is 60%-70% of the design upper limit of pressure drop. Preferably, in the initial reaction stage, the prehydrotreating reaction zone includes 3-6 prehydrotreating reactors, preferably 3-4 prehydrotreating reactors.

In a preferred embodiment, in the initial reaction stage, the transition reaction zone doesn't include any prehydrotreating reactor; moreover, the control unit controls material feeding to and material discharging from the prehydrotreating reactors in the prehydrotreating reaction zone according to pressure drop signals from the sensor units, so that:

when the pressure drop in one prehydrotreating reactor reaches the predetermined value, the prehydrotreating reactor is switched from the prehydrotreating reaction zone to the transition reaction zone, and is named as a cut-out prehydrotreating reactor I, and the prehydrotreating reaction zone, the cut-out prehydrotreating reactor I, and the hydrotreating reaction zone are connected in series successively;

when the pressure drop in the next one prehydrotreating reactor reaches the predetermined value, the prehydrotreating reactor is switched from the prehydrotreating reaction zone to the transition reaction zone, and is named as a cut-out prehydrotreating reactor II, and the prehydrotreating reaction zone, the cut-out prehydrotreating reactor II, the cut-out prehydrotreating reactor I, and the hydrotreating reaction zone are connected in series successively;

The other prehydrotreating reactors are treated in the above-mentioned method, till all of the prehydrotreating reactors are connected in series.

Preferably, the hydrotreating reaction zone includes 1-5 hydrotreating reactors connected in series, more preferably includes 1-2 hydrotreating reactors connected in series.

In a preferred embodiment, in the prehydrotreating reaction zone, the discharge outlet of any one prehydrotreating reactor is connected through a pipeline with a control valve to the feed inlets of other prehydrotreating reactors and the feed inlet of the hydrotreating reaction zone, the feed inlet of any one prehydrotreating reactor is connected through a pipeline with a control valve to a supply source of mixed flow of heavy oil raw material and hydrogen, wherein, the control unit controls material feeding and discharging by controlling the control valves corresponding to the prehydrotreating reactors.

The present invention further provides a heavy oil hydrotreating method, which comprises: mixing the heavy oil raw material with hydrogen, and then feeding the mixture through the prehydrotreating reaction zone, transition reaction zone, and hydrotreating reaction zone that are connected in series; In the initial reaction stage, the prehydrotreating reaction zone includes at least two prehydrotreating reactors connected in parallel, and the transition reaction zone includes or doesn't include prehydrotreating reactors;

in the reaction process, when the pressure drop in any one of the prehydrotreating reactors in the prehydrotreating reaction zone reaches a predetermined value, the prehydrotreating reactor in which the pressure drop reaches the predetermined value is switched to the transition reaction zone, wherein, the predetermined value of pressure drop in the prehydrotreating reactors is 50%-80% of a design upper limit of pressure drop for the prehydrotreating reactors, preferably is 60%-70% of the design upper limit of pressure drop.

Preferably, in the initial reaction stage, the prehydrotreating reaction zone includes 3-6 prehydrotreating reactors, preferably 3-4 prehydrotreating reactors.

In a preferred embodiment, in the initial reaction stage, the transition reaction zone doesn't include any prehydrotreating reactor; in addition, when the pressure drop in one prehydrotreating reactor reaches the predetermined value, the prehydrotreating reactor is switched from the prehydrotreating reaction zone to the transition reaction zone, and is named as a cut-out prehydrotreating reactor I, and the prehydrotreating reaction zone, the cut-out prehydrotreating reactor I, and the hydrotreating reaction zone are connected in series successively;

when the pressure drop in the next one prehydrotreating reactor reaches the predetermined value, the prehydrotreating reactor is switched from the prehydrotreating reaction zone to the transition reaction zone, and is named as a cut-out prehydrotreating reactor II, and the prehydrotreating reaction zone, the cut-out prehydrotreating reactor II, the cut-out prehydrotreating reactor I, and the hydrotreating reaction zone are connected in series successively;

The other prehydrotreating reactors are treated in the above-mentioned method, till all of the prehydrotreating reactors are connected in series.

Preferably, the pressure drops in all of the prehydrotreating reactors are controlled so that they don't reach the predetermined value at the same time, and preferably the time difference between the times when the pressure drops in two adjacent prehydrotreating reactors in which the pressure drops are closest to the predetermined value of pressure drop reach the predetermined value of pressure drop is not smaller than 20% of the entire running period, preferably is 20%-60% of the entire running period.

Preferably, the pressure drops in each prehydrotreating reactor in the prehydrotreating reaction zone are controlled so that they don't reach the predetermined value of pressure drop at the same time by setting operating conditions and/or utilizing the differences in the properties of the catalyst bed layers, more preferably, the pressure drops in each prehydrotreating reactor in the prehydrotreating reaction zone are controlled so that they don't reach the predetermined value of pressure drop at the same time, by controlling one or more of different catalyst packing heights in each prehydrotreating reactor, different feed rates of each prehydrotreating reactor, different properties of the feed materials, different operating conditions, and different catalyst packing densities under a condition of the same packing height.

In the case that the approach of controlling different catalyst packing densities in each prehydrotreating reactor under a condition of the same catalyst packing height is used, in each prehydrotreating reactor connected in parallel in the prehydrotreating reaction zone, the maximum packing density is 400 kgm$^3$-600 kg/m$^3$, preferably is 450 kg/m$^3$-550 kg/m$^3$; the minimum packing density is 300 kg/m$^3$-550 kg/m$^3$, preferably is 350 kg/m$^3$-450 kg/m$^3$;

preferably, the difference between catalyst packing densities of two prehydrotreating reactors in which the packing densities are the closest to each other is 50-200 kg/m$^3$, preferably is 80-150 kg/m$^3$. In the case that the approach of controlling different feed rates of each prehydrotreating reactor is used, the ratio of volumetric space velocities of material feeding to two prehydrotreating reactors of which the feed rates are the closest to each other is 1.1-3:1, preferably is 1.1-1.5:1.

In the case that the approach of controlling the properties of feed materials in each prehydrotreating reactor is used, the difference between metals contents in the feed materials in two prehydrotreating reactors of which the properties of feed materials are the closest to each other is 5-50 μg/g, preferably is 10-30 μg/g.

In the case that the approach of controlling the different operating conditions in each prehydrotreating reactor is used, in the operating conditions of two prehydrotreating reactors in which the operating pressures and volumetric space velocities are controlled to be the closest, the difference in operating temperature is 2-30° C., preferably is 5-20° C.; or in the operating conditions of two prehydrotreating reactors in which the operating pressure and operating temperature are controlled to be the closest, the difference in volumetric space velocity is 0.1-10 h$^{-1}$, preferably is 0.2-5 h$^{-1}$.

Preferably, in the material flow direction, hydrogenation protectant, hydro-demutualization catalyst, and optional hydro-desulphurization catalyst are charged in each prehydrotreating reactor in sequence; hydro-desulfurization catalyst and hydro-denitrogenation residual carbon conversion catalyst are charged in the reactors in the hydrotreating reaction zone in sequence.

Preferably, the operating conditions of the prehydrotreating reaction zone include: temperature: 370° C.-420° C., preferably 380° C.-400° C.; pressure: 10 MPa-25 MPa, preferably 15 MPa-20 MPa; volume ratio of hydrogen to oil: 300-1,500, preferably 500-800; liquid hour space velocity (LHSV) of raw oil: 0.15 h$^{-1}$-2 h$^{-1}$, preferably 0.3 h$^{-1}$-1 h$^{-1}$.

Preferably, the hydrotreating reaction zone includes 1-5 hydrotreating reactors connected in series, more preferably includes 1-2 hydrotreating reactors connected in series.

Preferably, the operating conditions of the hydrotreating reaction zone include: temperature: 370° C.-430° C., preferably 380° C.-410° C.; pressure: 10 MPa-25 MPa, preferably 15 MPa-20 MPa; volume ratio of hydrogen to oil: 300-1,500, preferably 400-800; liquid hour space velocity (LHSV) of raw oil: 0.15 h$^{-1}$-0.8 h$^{-1}$, preferably 0.2 h$^{-1}$-0.6 h$^{-1}$.

Preferably, the heavy oil raw material is selected from atmospheric heavy oil and/or vacuum residual oil; more preferably, the heavy oil raw material is blended with at least one of straight run wax oil, vacuum wax oil, secondary processed wax oil, and catalytic recycle oil.

The heavy oil hydrotreating system and the heavy oil hydrotreating method provided in the present invention have the following advantages:

(1) In the initial reaction stage, the prehydrotreating reaction zone includes a plurality of prehydrotreating reactors connected in parallel, so that the overall metal removing/containing capability of the entire catalyst system is greatly improved.

(2) In the heavy oil hydrotreating system provided in the present invention, when the pressure drop in one prehydrotreating reactor is increased to a predetermined value, the prehydrotreating reactor is switched from the prehydrotreating reaction zone to the transition reaction zone connected with the prehydrotreating reaction zone in series, so that the pressure drop will not be increased anymore; instead, the pressure drop will be increased slowly within a controlled range, till the apparatus is shut down; thus, the running period of the entire apparatus is not limited by the pressure drop in a prehydrotreating reactor.

(3) In the heavy oil hydrotreating system provided in the present invention, by adjusting the prehydrotreating reactors in each prehydrotreating reaction zone from parallel connection to serial connection, the problem of rapid increase of pressure drop in the prehydrotreating reactors is solved, and the flexibility of operation of the apparatus and the adaptability of the raw material are improved.

(4) In the heavy oil hydrotreating method provided in the present invention, by arranging the prehydrotreating reactor in a parallel connected layout, the metal containing capacity of the catalyst system is greatly improved, and thereby the stability of the system is enhanced, so that the increased of pressure drop in the apparatus is controlled, and the running period of the apparatus is prolonged.

(5) The heavy oil hydrotreating method provided in the present invention can maximize synchronous deactivation of the catalysts, and thereby improve the operating efficiency of the apparatus and improve economic benefit.

(6) In the heavy oil hydrotreating method provided in the present invention, by optimizing and adjusting the catalyst performance and process parameters in the prehydrotreating reaction zone, in conjunction with utilizing high-activity desulphurization and residual carbon removing catalysts in the follow-up procedures, the desulphurization and residual carbon removing performance is ensured, while the metal removing/containing capability of the entire catalyst system is improved.

Other features and advantages of the present invention will be further detailed in the embodiments hereunder.

DESCRIPTION OF THE DRAWINGS

The accompanying drawings are provided here to facilitate further understanding on the present invention, and constitute a part of this document. They are used in conjunction with the following embodiments to explain the present invention, but shall not be comprehended as constituting any limitation to the present invention. In the FIGURES:

FIG. 1 is a schematic diagram of an embodiment of the heavy oil hydrotreating system according to the present invention.

DETAILED DESCRIPTION OF THE EMBODIMENTS

Hereunder some embodiments of the present invention will be detailed. It should be understood that the embodiments described here are only provided to describe and explain the present invention, but shall not be deemed as constituting any limitation to the present invention.

The ends points and any value in the ranges disclosed in the present invention are not limited to the exact ranges or values; instead, those ranges or values shall be comprehended as encompassing values that are close to those ranges or values. For numeric ranges, the end points of the ranges, the end points of the ranges and the discrete point values, and the discrete point values may be combined to obtain one or more new numeric ranges, which shall be deemed as having been disclosed specifically in this document.

The heavy oil hydrotreating system provided in the present invention comprises a prehydrotreating reaction zone, a transition reaction zone, and a hydrotreating reaction zone that are connected in series, and sensor units and a control unit, wherein, the sensor units are configured to detect pressure drop in each prehydrotreating reactor in the prehydrotreating reaction zone, and the control unit is configured to receive pressure drop signals from the sensor units;

In the initial reaction stage, the prehydrotreating reaction zone includes at least two prehydrotreating reactors connected in parallel, and the transition reaction zone includes or doesn't include prehydrotreating reactors;

In the reaction process, the control unit controls material feeding to and material discharging from each prehydrotreating reactor in the prehydrotreating reaction zone according to pressure drop signals of the sensor units, so that when the pressure drop in any of the prehydrotreating reactors in the prehydrotreating reaction zone reaches a predetermined value, the prehydrotreating reactor in which the pressure drop reaches the predetermined value is switched from the prehydrotreating reaction zone to the transition reaction zone.

In the heavy oil hydrotreating system provided in the present invention, the predetermined value for the prehydrotreating reactors preferably is 50%-80% of a design upper limit of pressure drop for the prehydrotreating reactors, such as 50%, 52%, 54%, 55%, 56%, 57%, 58%, 60%, 61%, 62%, 63%, 64%, 65%, 66%, 67%, 68%, 69%, 70%, 71%, 72%, 74%, 75%, 76%, 78%, or 80%, or any value between a range constituted by any two of the values. Preferably, the predetermined value is 60%-70% of the design upper limit of pressure drop. In the present invention, the design upper limit of pressure drop refers to the maximum value of pressure drop in the reactors. When the pressure drop in a reactor reaches the value, the reaction system should be shut down. The design upper limit of pressure drop usually is 0.7-1 MPa.

In the heavy oil hydrotreating system provided in the present invention, in the initial reaction stage, the transition reaction zone may include or not include prehydrotreating reactors. Preferably, in the initial reaction stage, the transition reaction zone doesn't include any prehydrotreating reactor. In the heavy oil hydrotreating system provided in the present invention, in the reaction process, the prehydrotreating reaction zone includes at least one prehydrotreating reactor. Moreover, if the prehydrotreating reaction zone includes only two prehydrotreating reactors in the initial reaction stage, the operation of switching a prehydrotreating reactor from the prehydrotreating reaction zone to the transition reaction zone has to performed only once; if the prehydrotreating reaction zone includes three or more prehydrotreating reactors in the initial reaction stage, the operation of switching a prehydrotreating reactor from the prehydrotreating reaction zone to the transition reaction zone may be performed once or more times. Preferably, in the initial reaction stage, the prehydrotreating reaction zone includes 3-6 prehydrotreating reactors, preferably 3-4 prehydrotreating reactors. Further preferably, the operation of switching a prehydrotreating reactor from the prehydrotreating reaction zone to the transition reaction zone is performed so that only one prehydrotreating reactor exists in the prehydrotreating reaction zone in the final stage of reaction. In the heavy oil hydrotreating system provided in the present invention, in the initial reaction stage, the transition reaction zone may include or not include prehydrotreating reactors. In the reaction process, when a prehydrotreating reactor is switched from the prehydrotreating reaction zone to the transition reaction zone and the transition reaction zone includes a plurality of prehydrotreating reactors, the plurality of prehydrotreating reactors in the transition reaction zone may be connected in series and/or in parallel; preferably, the plurality of prehydrotreating reactors in the transition reaction zone are connected in series; optimally, the plurality of prehydrotreating reactors in the transition reaction zone are arranged in series, and, in the material flow direction in the transition reaction zone, prehydrotreating reactors switched from the prehydrotreating reaction zone earlier are arranged at the downstream, while prehydrotreating reactors switched from the prehydrotreating reaction zone later are arranged at the upstream.

According to an optimal embodiment of the heavy oil hydrotreating system provided in the present invention, in the initial reaction stage, the transition reaction zone doesn't include any prehydrotreating reactor, and the prehydrotreating reaction zone includes 3-6 prehydrotreating reactors, preferably includes 3-4 prehydrotreating reactors;

Moreover, the control unit controls material feeding to and material discharging from the prehydrotreating reactors in the prehydrotreating reaction zone according to pressure drop signals from the sensor units, so that:

When the pressure drop in one prehydrotreating reactor reaches the predetermined value, the prehydrotreating reactor is switched from the prehydrotreating reaction zone to the transition reaction zone, and is named as a cut-out prehydrotreating reactor I, and the prehydrotreating reaction zone, the cut-out prehydrotreating reactor I, and the hydrotreating reaction zone are connected in series successively;

When the pressure drop in the next one prehydrotreating reactor reaches the predetermined value, the prehydrotreating reactor is switched from the prehydrotreating reaction zone to the transition reaction zone, and is named as a cut-out prehydrotreating reactor II, and the prehydrotreating reaction zone, the cut-out prehydrotreating reactor II, the cut-out prehydrotreating reactor I, and the hydrotreating reaction zone are connected in series successively;

The other prehydrotreating reactors are treated in the above-mentioned method, till all of the prehydrotreating reactors are connected in series. In the embodiment, among all of the prehydrotreating reactors connected in series, according to the order in which the pressure drops reach the predetermined value, prehydrotreating reaction zones in which the pressure drop reaches the predetermined value earlier are arranged at the downstream, prehydrotreating reaction zones in which the pressure drop reaches the predetermined value later are arranged at the upstream, and prehydrotreating reactor in which the pressure drop reaches the predetermined value first is arranged at the most downstream position.

According to an embodiment of the heavy oil prehydrotreating system, as shown in FIG. 1, in the prehydrotreating reaction zone, the discharge outlet of any one prehydrotreating reactor is connected through a pipeline with a control valve to the feed inlets of other prehydrotreating reactors and the feed inlet of the hydrotreating reaction zone, the feed inlet of any one prehydrotreating reactor is connected through a pipeline with a control valve to a supply source of mixed flow of heavy oil raw material and hydrogen, wherein, the control unit controls material feeding and discharging by controlling the control valves corresponding to each prehydrotreating reactor.

In the heavy oil hydrotreating system provided in the present invention, the hydrotreating reaction zone may include 1-5 hydrotreating reactors arranged in series, preferably includes 1-2 hydrotreating reactors arranged in series.

FIG. 1 is a schematic diagram of a preferred embodiment of the heavy oil hydrotreating system according to the present invention. Hereunder the heavy oil hydrotreating method and the heavy oil hydrotreating system provided in the present invention will be further detailed with reference to FIG. 1. However, the present invention is not limited to the embodiment.

As shown in FIG. 1, the heavy oil hydrotreating system and the heavy oil hydrotreating method provided in the present invention comprise: a heavy oil raw material is mixed with hydrogen to obtain a mixture F, then the mixture F is fed through a feeding pipeline 1, a feeding pipeline 2 and a feeding pipeline 3 into a prehydrotreating reaction zone and a hydro-desulfurization reaction zone connected in series, wherein, the prehydrotreating reaction zone includes three prehydrotreating reactors arranged in parallel, i.e., prehydrotreating reactor A, prehydrotreating reactor B, and prehydrotreating reactor C, the feed inlets of the prehydrotreating reactor A, prehydrotreating reactor B and prehydrotreating reactor C are connected with the feeding pipeline 1, feeding pipeline 2 and feeding pipeline 3 respectively, the outlet of the prehydrotreating reactor A is split into three branches, the first branch is connected through a pipeline 6 to the feed inlet of the prehydrotreating reactor B, the second branch is connected through a pipeline 7 to the feed inlet of the prehydrotreating reactor C, and the third branch is connected through a pipeline 10 to the feed inlet of a hydro-desulfurization reactor D; the outlet of the prehydrotreating reactor B is split into three branches, the first branch is connected through a pipeline 4 to the feed inlet of the prehydrotreating reactor A, the second branch is connected through a pipeline 5 to the feed inlet of the prehydrotreating reactor C, and the third branch is connected through a pipeline 11 to the feed inlet of the hydro-desulfurization reactor D; the outlet of the prehydrotreating reactor C is split into three branches, the first branch is connected through a pipeline 8 to the feed inlet of the prehydrotreating reactor A, the second branch is connected through a pipeline 9 to the feed inlet of the prehydrotreating reactor B, and the third branch is connected through a pipeline 12 to the feed inlet of the hydro-desulfurization reactor D; the pipeline 1 is provided with a valve 101, the pipeline 2 is provided with a valve 102, the pipeline 3 is provided with a valve 103, the pipeline 4 is provided with a valve 104, the pipeline 5 is provided with a valve 105, the pipeline 6 is provided with a valve 106, the pipeline 7 is provided with a valve 107, the pipeline 8 is provided with a valve 108, the pipeline 9 is provided with a valve 109, the pipeline 10 is provided with a valve 1010, the pipeline 11 is provided with a valve 1011, the pipeline 12 is provided with a valve 1012, the resultant oil obtained in the hydro-desulfurization reactor flows into a separator E and is separated to obtain liquefied gas 14 and resultant oil 15 generated by hydrogenation, and the resultant oil 15 generated by hydrogenation may be further fractionated into different distillates. The prehydrotreating reactor A, the prehydrotreating reactor B, and the prehydrotreating reactor C are respectively provided with a sensor unit (not shown) for monitoring pressure drop in them; in addition, the heavy oil hydrotreating system further comprises a control unit (not shown) configured to receive pressure drop signals from the sensor units and control the valves corresponding to the prehydrotreating reactors according to the pressure drop signals.

In the heavy oil hydrotreating system described above, the prehydrotreating reactor A, the prehydrotreating reactor B and the prehydrotreating reactor C may be deactivated in any order, and the switching operations may be performed according to the following six schemes:

Scheme 1: The pressure drops reach the predetermined value of pressure drop in the sequence of prehydrotreating reactor A, prehydrotreating reactor B, and prehydrotreating reactor C.

(1) At the start-up, the valve 101, valve 102, valve 103, valve 1010, valve 1011, and valve 1012 on the pipeline 1, pipeline 2, pipeline 3, pipeline 10, pipeline 11, pipeline 12 are opened, and the valve 104, valve 105, valve 106, valve 107, valve 108, and valve 109 on the pipeline 4, pipeline 5, pipeline 6, pipeline 7, pipeline 8, and pipeline 9 are closed;

(2) The pressure drops in the prehydrotreating reactor A, prehydrotreating reactor B and prehydrotreating reactor C are detected with the sensor units; when the pressure drop in the prehydrotreating reactor A reaches a predetermined value, the pressure drop signal from the sensor unit corresponding to the prehydrotreating reactor A is transmitted to the control unit, and the control unit executes regulation and control of the valves after receiving the signal; specifically, the valve 101 on the feeding pipeline 1, the valve 1011 on the pipeline 11, and the valve 1012 on the pipeline 12 are closed, the valve 108 on the pipeline 8 and the valve 104 on the pipeline 4 are opened, so that the prehydrotreating reaction zone (including the prehydrotreating reactor B and the prehydrotreating reactor C), the prehydrotreating reactor A, and the hydro-desulfurization reaction zone are connected in series, and a switching operation from parallel connection to serial connection is accomplished at this point;

(3) When the pressure drop in the prehydrotreating reactor B reaches the predetermined value, a pressure drop signal from the sensor unit corresponding to the prehydrotreating reactor B is transmitted to the control unit, and the control unit executes regulation and control of the valves after receiving the signal; specifically, the valve 102 on the feeding pipeline 2 and the valve 108 on the pipeline 8 are closed, and the valve 109 on the pipeline 9 is opened, so that the prehydrotreating reactor C, the prehydrotreating reactor B, the prehydrotreating reactor A, and the hydro-desulfurization reaction zone are connected in series; thus, a second switching operation from parallel connection to serial connection is accomplished at this point;

(4) When the pressure drop in the prehydrotreating reactor C reaches the design upper limit, the entire reaction system should be shut down.

Scheme 2: The pressure drops reach the predetermined value of pressure drop in the sequence of prehydrotreating reactor A, prehydrotreating reactor C, and prehydrotreating reactor B.

(1) At the start-up, the valve 101, valve 102, valve 103, valve 1010, valve 1011, and valve 1012 on the pipeline 1, pipeline 2, pipeline 3, pipeline 10, pipeline 11, pipeline 12 are opened, and the valve 104, valve 105, valve 106, valve 107, valve 108, and valve 109 on the pipeline 4, pipeline 5, pipeline 6, pipeline 7, pipeline 8, and pipeline 9 are closed;

(2) The pressure drops in the prehydrotreating reactor A, prehydrotreating reactor B and prehydrotreating reactor C are detected with the sensor units; when the pressure drop in the prehydrotreating reactor A reaches a predetermined value, the pressure drop signal from the sensor unit corresponding to the prehydrotreating reactor A is transmitted to the control unit, and the control unit executes regulation and control of the valves after receiving the signal; specifically, the valve 101 on the feeding pipeline 1, the valve 1011 on the pipeline 11, and the valve 1012 on the pipeline 12 are closed, the valve 108 on the pipeline 8 and the valve 104 on the pipeline 4 are opened, so that the prehydrotreating reaction zone (including the prehydrotreating reactor B and the prehydrotreating reactor C), the prehydrotreating reactor A, and the hydro-desulfurization reaction zone are connected in series, and a switching operation from parallel connection to serial connection is accomplished at this point;

(3) When the pressure drop in the prehydrotreating reactor C reaches the predetermined value, a pressure drop signal from the sensor unit corresponding to the prehydrotreating reactor C is transmitted to the control unit, and the control unit executes regulation and control of the valves after receiving the signal; specifically, the valve 103 on the feeding pipeline 3 and the valve 104 on the pipeline 4 are closed, and the valve 105 on the pipeline 5 is opened, so that the prehydrotreating reactor B, the prehydrotreating reactor C, the prehydrotreating reactor A, and the hydro-desulfurization reaction zone are connected in series; thus, a second switching operation from parallel connection to serial connection is accomplished at this point;

(4) When the pressure drop in the prehydrotreating reactor C reaches the predetermined value, the entire reaction system should be shut down.

Scheme 3: The pressure drops reach the predetermined value of pressure drop in the sequence of prehydrotreating reactor B, prehydrotreating reactor C, and prehydrotreating reactor A.

(1) At the start-up, the valve 101, valve 102, valve 103, valve 1010, valve 1011, and valve 1012 on the pipeline 1, pipeline 2, pipeline 3, pipeline 10, pipeline 11, pipeline 12 are opened, and the valve 104, valve 105, valve 106, valve 107, valve 108, and valve 109 on the pipeline 4, pipeline 5, pipeline 6, pipeline 7, pipeline 8, and pipeline 9 are closed;

(2) The pressure drops in the prehydrotreating reactor A, prehydrotreating reactor B and prehydrotreating reactor C are detected with the sensor units; when the pressure drop in the prehydrotreating reactor B reaches a predetermined value, the pressure drop signal from the sensor unit corresponding to the prehydrotreating reactor B is transmitted to the control unit, and the control unit executes regulation and control of the valves after receiving the signal; specifically, the valve 102 on the feeding pipeline 2, the valve 1010 on the pipeline 10, and the valve 1012 on the pipeline 12 are closed, the valve 109 on the pipeline 9 and the valve 106 on the pipeline 6 are opened, so that the prehydrotreating reaction zone (including the prehydrotreating reactor A and the prehydrotreating reactor C), the prehydrotreating reactor B, and the hydro-desulfurization reaction zone are connected in series, and a switching operation from parallel connection to serial connection is accomplished at this point;

(3) When the pressure drop in the prehydrotreating reactor C reaches the predetermined value, a pressure drop signal from the sensor unit corresponding to the prehydrotreating reactor C is transmitted to the control unit, and the control unit executes regulation and control of the valves after receiving the signal; specifically, the valve 103 on the feeding pipeline 3 and the valve 106 on the pipeline 6 are closed, and the valve 107 on the pipeline 7 is opened, so that the prehydrotreating reactor A, the prehydrotreating reactor C, the prehydrotreating reactor B, and the hydro-desulfurization reaction zone are connected in series; thus, a second switching operation from parallel connection to serial connection is accomplished at this point;

(4) When the pressure drop in the prehydrotreating reactor A reaches the predetermined value, the entire reaction system should be shut down.

Scheme 4: The pressure drops reach the predetermined value of pressure drop in the sequence of prehydrotreating reactor B, prehydrotreating reactor A, and prehydrotreating reactor C.

(1) At the start-up, the valve 101, valve 102, valve 103, valve 1010, valve 1011, and valve 1012 on the pipeline 1, pipeline 2, pipeline 3, pipeline 10, pipeline 11, pipeline 12 are opened, and the valve 104, valve 105, valve 106, valve 107, valve 108, and valve 109 on the pipeline 4, pipeline 5, pipeline 6, pipeline 7, pipeline 8, and pipeline 9 are closed;

(2) The pressure drops in the prehydrotreating reactor A, prehydrotreating reactor B and prehydrotreating reactor C are detected with the sensor units; when the pressure drop in the prehydrotreating reactor B reaches a predetermined value, the pressure drop signal from the sensor unit corresponding to the prehydrotreating reactor B is transmitted to the control unit, and the control unit executes regulation and control of the valves after receiving the signal; specifically, the valve 102 on the feeding pipeline 2, the valve 1010 on the pipeline 10, and the valve 1012 on the pipeline 12 are closed, the valve 109 on the pipeline 9 and the valve 106 on the pipeline 6 are opened, so that the prehydrotreating reaction zone (including the prehydrotreating reactor A and the prehydrotreating reactor C), the prehydrotreating reactor B, and the hydro-desulfurization reaction zone are connected in series, and a switching operation from parallel connection to serial connection is accomplished at this point;

(3) When the pressure drop in the prehydrotreating reactor A reaches the predetermined value, a pressure drop signal from the sensor unit corresponding to the prehydrotreating reactor A is transmitted to the control unit, and the control unit executes regulation and control of the valves after receiving the signal; specifically, the valve 101 on the feeding pipeline 1 and the valve 109 on the pipeline 9 are closed, and the valve 108 on the pipeline 8 is opened, so that the prehydrotreating reactor C, the prehydrotreating reactor A, the prehydrotreating reactor B, and the hydro-desulfurization reaction zone are connected in series; thus, a second switching operation from parallel connection to serial connection is accomplished at this point;

(4) When the pressure drop in the prehydrotreating reactor C reaches the predetermined value, the entire reaction system should be shut down.

Scheme 5: The pressure drops reach the predetermined value of pressure drop in the sequence of prehydrotreating reactor C, prehydrotreating reactor B, and prehydrotreating reactor A.

(1) At the start-up, the valve 101, valve 102, valve 103, valve 1010, valve 1011, and valve 1012 on the pipeline 1, pipeline 2, pipeline 3, pipeline 10, pipeline 11, pipeline 12 are opened, and the valve 104, valve 105, valve 106, valve 107, valve 108, and valve 109 on the pipeline 4, pipeline 5, pipeline 6, pipeline 7, pipeline 8, and pipeline 9 are closed;

(2) The pressure drops in the prehydrotreating reactor A, prehydrotreating reactor B and prehydrotreating reactor C are detected with the sensor units; when the pressure drop in the prehydrotreating reactor C reaches a predetermined value, the pressure drop signal from the sensor unit corresponding to the prehydrotreating reactor C is transmitted to the control unit, and the control unit executes regulation and control of the valves after receiving the signal; specifically, the valve 103 on the feeding pipeline 3, the valve 1010 on the pipeline 10, and the valve 1011 on the pipeline 11 are closed, the valve 107 on the pipeline 7 and the valve 105 on the pipeline 5 are opened, so that the prehydrotreating reaction zone (including the prehydrotreating reactor A and the prehydrotreating reactor B), the prehydrotreating reactor C, and the hydro-desulfurization reaction zone are connected in series, and a switching operation from parallel connection to serial connection is accomplished at this point;

(3) When the pressure drop in the prehydrotreating reactor B reaches the predetermined value, a pressure drop signal from the sensor unit corresponding to the prehydrotreating reactor B is transmitted to the control unit, and the control unit executes regulation and control of the valves after receiving the signal; specifically, the valve 102 on the feeding pipeline 2 and the valve 107 on the pipeline 7 are closed, and the valve 106 on the pipeline 6 is opened, so that the prehydrotreating reactor A, the prehydrotreating reactor B, the prehydrotreating reactor C, and the hydro-desulfurization reaction zone are connected in series; thus, a second switching operation from parallel connection to serial connection is accomplished at this point;

(4) When the pressure drop in the prehydrotreating reactor A reaches the predetermined value, the entire reaction system should be shut down.

Scheme 6: The pressure drops reach the predetermined value of pressure drop in the sequence of prehydrotreating reactor C, prehydrotreating reactor A, and prehydrotreating reactor B.

(1) At the start-up, the valve 101, valve 102, valve 103, valve 1010, valve 1011, and valve 1012 on the pipeline 1, pipeline 2, pipeline 3, pipeline 10, pipeline 11, pipeline 12 are opened, and the valve 104, valve 105, valve 106, valve 107, valve 108, and valve 109 on the pipeline 4, pipeline 5, pipeline 6, pipeline 7, pipeline 8, and pipeline 9 are closed;

(2) The pressure drops in the prehydrotreating reactor A, prehydrotreating reactor B and prehydrotreating reactor C are detected with the sensor units; when the pressure drop in the prehydrotreating reactor C reaches a predetermined value, the pressure drop signal from the sensor unit corresponding to the prehydrotreating reactor C is transmitted to the control unit, and the control unit executes regulation and control of the valves after receiving the signal; specifically, the valve 103 on the feeding pipeline 3, the valve 1010 on the pipeline 10, and the valve 1011 on the pipeline 11 are closed, the valve 107 on the pipeline 7 and the valve 105 on the pipeline 5 are opened, so that the prehydrotreating reaction zone (including the prehydrotreating reactor A and the prehydrotreating reactor B), the prehydrotreating reactor C, and the hydro-desulfurization reaction zone are connected in series, and a switching operation from parallel connection to serial connection is accomplished at this point;

(3) When the pressure drop in the prehydrotreating reactor A reaches the predetermined value, a pressure drop signal from the sensor unit corresponding to the prehydrotreating reactor A is transmitted to the control unit, and the control unit executes regulation and control of the valves after receiving the signal; specifically, the valve 101 on the feeding pipeline 1 and the valve 105 on the pipeline 5 are closed, and the valve 104 on the pipeline 4 is opened, so that the prehydrotreating reactor B, the prehydrotreating reactor A, the prehydrotreating reactor C, and the hydro-desulfurization reaction zone are connected in series; thus, a second switching operation from parallel connection to serial connection is accomplished at this point;

(4) When the pressure drop in the prehydrotreating reactor B reaches the predetermined value, the entire reaction system should be shut down.

The heavy oil hydrotreating method provided in the present invention comprises: mixing the heavy oil raw material with hydrogen, and then feeding the mixture through the prehydrotreating reaction zone, transition reaction zone, and hydrotreating reaction zone that are connected in series; wherein, in the initial reaction stage, the prehydrotreating reaction zone includes at least two prehydrotreating reactors connected in parallel, and the transition reaction zone includes or doesn't include prehydrotreating reactors;

in the reaction process, when the pressure drop in any one of the prehydrotreating reactor in the prehydrotreating reaction zone reaches a predetermined value, the prehydrotreating reactor in which the pressure drop reaches the predetermined value is switched from the prehydrotreating reaction zone to the transition reaction zone.

In the heavy oil hydrotreating method provided in the present invention, in the initial reaction stage, the prehydrotreating reaction zone includes at least two prehydrotreating reactors connected in parallel. In the follow-up reaction process, as the pressure drops in the prehydrotreating reactors reach the predetermined value gradually, the prehydrotreating reactors in which the pressure drop reaches the predetermined value are switched from the prehydrotreating reaction zone to the transition reaction zone, till only one prehydrotreating reactor is left in the prehydrotreating reaction zone.

In a case that the prehydrotreating reaction zone includes two prehydrotreating reactors arranged in parallel in the initial reaction stage, in the reaction process, when the pressure drop in either of the prehydrotreating reactors in the prehydrotreating reaction zone reaches the predetermined value, the prehydrotreating reactor in which the pressure drop reaches the predetermined value is switched to the transition reaction zone, till the pressure drop in the remaining prehydrotreating reactor in the prehydrotreating reaction zone reaches the design upper limit (usually is 0.7-1 MPa); at that point, the entire reaction process is terminated, and the entire reaction system should be shut down.

In a case that the prehydrotreating reaction zone includes three or more (preferably 3-6, more preferably 3-4) prehydrotreating reactors arranged in parallel in the initial reaction stage and the transition reaction zone doesn't include any prehydrotreating reactor, in the reaction process, when the pressure drop in a prehydrotreating reactor reaches the predetermined value, the prehydrotreating reactor in which the pressure drop reaches the predetermined value is switched from the prehydrotreating reaction zone to the transition reaction zone and is named as cut-out prehydrotreating reactor I, and the prehydrotreating reaction zone, the cut-out prehydrotreating reactor I, and the hydrotreating reaction zone are connected in series successively;

When the pressure drop in the next prehydrotreating reactor reaches the predetermined value, the prehydrotreating reactor is switched out from the prehydrotreating reaction zone and is named as a cut-out prehydrotreating reactor II, and the prehydrotreating reaction zone, the cut-out prehydrotreating reactor II, the cut-out prehydrotreating reactor I, and the hydrotreating reaction zone are connected in series successively; The other prehydrotreating reactors are treated in the above-mentioned method, till all of the prehydrotreating reactors are connected in series. In the embodiment, among all of the prehydrotreating reactors connected in series, according to the order in which the pressure drops reach the predetermined value, prehydrotreating reaction zones in which the pressure drop reaches the predetermined value earlier are arranged at the downstream, prehydrotreating reaction zones in which the pressure drop reaches the predetermined value later are arranged at the upstream, and prehydrotreating reactor in which the pressure drop reaches the predetermined value first is arranged at the most downstream position.

In the heavy oil hydrotreating method provided in the present invention, the predetermined value is 50%-80% of the design upper limit of pressure drop, such as, 50%, 52%, 54%, 55%, 56%, 57%, 58%, 60%, 61%, 62%, 63%, 64%, 65%, 66%, 67%, 68%, 69%, 70%, 71%, 72%, 74%, 75%, 76%, 78%, or 80%, or any value between the range constituted by any two of the values. Preferably, the predetermined value is 60%-70% of the design upper limit of pressure drop. In the present invention, the design upper limit of pressure drop refers to the maximum value of pressure drop in the reactors. When the pressure drop in a reactor reaches the value, the reaction system should be shut down. The design upper limit of pressure drop usually is 0.7-1 MPa.

In the heavy oil hydrotreating method provided in the present invention, the pressure drops in all of the prehydrotreating reactors are controlled so that they don't reach the predetermined value at the same time. Preferably, the difference between the times when the pressure drops in adjacent two prehydrotreating reactors in which the pressure drops are the closest to the predetermined value reach the predetermined value is not smaller than 20% of the entire running period, preferably is 20-60% of the entire running period, such as 20%, 25%, 30%, 35%, 40%, 45%, 50%, 55%, or 60%. In the present invention, the entire running period refers to the duration from the time the heavy oil hydrotreating system is started to operate to the time the heavy oil hydrotreating system is shut down.

The pressure drops in the prehydrotreating reactors in the prehydrotreating reaction zone can be controlled so that they don't reach the predetermined value of pressure drop at the same time by setting operating conditions and/or utilizing the differences in the properties of the catalyst bed layers. Preferably, the pressure drops in the prehydrotreating reactors in the prehydrotreating reaction zone are controlled so that they don't reach the predetermined value of pressure drop at the same time, by controlling one or more of different catalyst packing heights in the prehydrotreating reactors, different feed rates of the prehydrotreating reactors, different properties of the feed materials, different operating conditions, and different catalyst packing densities under a condition of the same packing height.

In one embodiment, in the case that the approach of controlling different catalyst packing densities in each prehydrotreating reactor under a condition of the same catalyst packing height is used, in each prehydrotreating reactors connected in parallel in the prehydrotreating reaction zone, the maximum packing density may be 400 $kgm^3$-600 $kg/m^3$, preferably is 450 $kg/m^3$-550 $kg/m^3$; the minimum packing density may be 300 $kg/m^3$-550 $kg/m^3$, preferably is 350 $kg/m^3$-450 $kg/m^3$. Further preferably, the difference between catalyst packing densities of two prehydrotreating reactors in which the packing densities are the closest to each other is 50-200 $kg/m^3$, preferably is 80-150 $kg/m^3$. Specifically, the catalyst packing density in the prehydrotreating reactor that is cut out first is set to the highest value, the catalyst packing density in the prehydrotreating reactor that is cut out at last is set to the lowest value, and the catalyst packing densities in the prehydrotreating reactors are decreased successively in the cut-out order. Different catalyst packing densities may be achieved by graded loading of different types of catalysts. For example, the catalyst packing densities in the prehydrotreating reactors may be controlled to be different from each other by adding hydrogenation protectant, hydro-demetalization catalyst, and hydro-desulfurization catalyst in different proportions. In another embodiment, in the case that the approach of controlling different feed rates of each prehydrotreating reactor is used, the ratio of volumetric space velocities of material feeding to two prehydrotreating reactors of which the feed rates are the closest to each other may be 1.1-3:1, preferably is 1.1-1.5:1.

In another embodiment, in the case that the approach of controlling the properties of feed materials in each prehydrotreating reactor is used, the difference between metals contents in the feed materials in two prehydrotreating reactors of which the properties of feed materials are the closest to each other may be 5-50 μg/g, preferably is 10-30 μg/g.

In another embodiment, in the case that the approach of controlling the different operating conditions in each prehydrotreating reactor is used, in the operating conditions of two prehydrotreating reactors in which the operating pressures and volumetric space velocities are controlled to be the closest, the difference in operating temperature may be 2-30° C., preferably is 5-20° C.; or in the operating conditions of two prehydrotreating reactors in which the operating pressure and operating temperature are controlled to be the closest, the difference in volumetric space velocity may 0.1-10 $h^{-1}$, preferably is 0.2-5 $h^{-1}$.

In the heavy oil hydrotreating method provided in the present invention, the operating conditions of the prehydrotreating reaction zone may include: temperature: 370° C.-420° C., preferably 380° C.-400° C.; pressure: 10 MPa-25 MPa, preferably 15 MPa-20 MPa; volume ratio of hydrogen to oil: 300-1,500, preferably 500-800; liquid hour space velocity (LHSV) of raw oil: 0.15 $h^{-1}$-2 $h^{-1}$, preferably 0.3 $h^{-1}$-1 $h^{-1}$. Here, the pressure refers to the partial pressure of hydrogen at the inlet of reactor.

In the present invention, the average reaction temperature in the prehydrotreating reaction zone is apparently higher than the reaction temperatures in the heavy oil hydro-demetalization reactors in the prior art, which usually is 350° C.-390° C. In the method provided in the present invention, through optimization of the process flow, the prehydrotreating reaction zone arranged in the front part eliminates the drawback that the running period is limited by the increase of pressure drop, and the reactors can operate at a higher temperature; in addition, the higher reaction temperature is helpful for giving full play to the performance of the charged catalyst system, beneficial for hydrogenation conversion of large molecules and removal of impurities.

In the heavy oil hydrotreating method provided in the present invention, the hydrotreating reaction zone may include 1-5 hydrotreating reactors arranged in series, preferably includes 1-2 hydrotreating reactors arranged in series.

In the heavy oil hydrotreating method provided in the present invention, the operating conditions of the hydrotreating reaction zone may include: temperature: 370° C.-430° C., preferably 380° C.-410° C.; pressure: 10 MPa-25 MPa, preferably 15 MPa-20 MPa; volume ratio of hydrogen to oil: 300-1,500, preferably 400-800; liquid hour space velocity (LHSV) of raw oil: 0.15 $h^{-1}$-0.8 $h^{-1}$, preferably 0.2 $h^{-1}$-0.6 $h^{-1}$. Here, the pressure refers to the partial pressure of hydrogen at the inlet of reactor. In the heavy oil hydrotreating method provided in the present invention, a fixed bed heavy oil hydrotreating technique is used, one or more of hydrogenation protectant, hydro-demetalization catalyst, hydro-desulfurization catalyst, and hydro-denitrogenation residual carbon conversion catalyst may be charged in the prehydrotreating reactors in the prehydrotreating reaction zone, and one or more of hydro-desulfurization catalyst and hydro-denitrogenation residual carbon conversion catalyst may be charged in the reactors in the hydrotreating reaction zone.

In a preferred embodiment, in the material flow direction, hydrogenation protectant, hydro-demutualization catalyst, and optional hydro-desulphurization catalyst are charged in the prehydrotreating reactors in sequence; hydro-desulfurization catalyst and hydro-denitrogenation residual carbon conversion catalyst are charged in the reactors in the hydrotreating reaction zone in sequence. With the catalyst charging method in the preferred embodiment, the metal removing/containing capability of the entire system is greatly improved, and the increase of pressure drop in each of the prehydrotreating reactors is controlled with a controlled range by adjusting the catalyst grading. The catalyst system charged in the prehydrotreating reactors connected in parallel in the prehydrotreating reaction zone is mainly for the purpose of removing and containing metals, so that the hydrogenation conversion capability for large molecules (e.g., resin and asphaltene) in the raw material is strengthened, and thereby a basis is set for the follow-up deep desulfurization and conversion of residual carbon to make the hydro-desulfurization reaction zone helpful for further depth reaction. Therefore, compared with conventional techniques, in the method provided in the present invention, though the proportion of the hydro-demetalization catalyst is increased to a certain degree, the overall desulphurization activity and residual carbon hydrogenation conversion performance are improved rather than degraded.

In the present invention, the hydrogenation protectant, the hydro-demetalization catalyst, the hydro-desulfurization catalyst, and the hydro-denitrogenation and residual carbon conversion catalyst may be catalysts commonly used in fixed bed heavy oil hydrotreating processes. These catalysts usually utilize a porous refractory inorganic oxide (e.g., alumina) as a carrier, and oxides of VIB and/or VIII metals (e.g., W, Mo, Co., Ni, etc.) as active constituents, with different other additives (e.g., P, Si, F, B, etc.) added selectively. For example, the FZC series heavy oil hydrotreating catalysts produced by the Catalyst Branch of China Petroleum & Chemical Corporation may be used.

In the heavy oil hydrotreating method provided in the present invention, the heavy oil raw material may be a heavy oil raw material commonly used in fixed bed heavy oil hydrotreating processes, such as atmospheric heavy oil or vacuum residual oil, and is usually blended with one or more of straight-run gas oil, vacuum gas oil, secondary processed oil, and FCC recycle oil. The properties of the heavy oil raw material may be: sulfur content: ≤4 wt %, nitrogen content:

≤0.7 wt %, metal content (Ni+V): ≤120 μg/g, residual carbon value: ≤17 wt %, and asphaltene content: ≤5 wt %.

Hereunder the effects of the present invention will be detailed in specific embodiments. In the embodiments and a Comparative examples of the present invention, the raw materials include of three materials, i.e., raw material A, raw material B, and raw material C, the properties of which are shown in Table 1; the properties of the heavy oil hydrogenation catalyst is shown in Table 2; the charging method of the catalyst in the embodiments 1-4 is shown in Table 3, the charging method of the catalyst in the Comparative examples 1-4 is shown in Table 4, the reaction conditions in the embodiments 1-4 are shown in Table 5, the reaction conditions in the Comparative examples 1-4 are shown in Table 6, and the reaction results in the embodiments 1-4 and the Comparative examples 1-4 are shown in Table 7.

In the following examples and Comparative examples, the prehydrotreating reactor A, prehydrotreating reactor B, and prehydrotreating reactor C are reactors in the same form and size.

EXAMPLES

Example 1

In this example, the switching operation is performed with the above-mentioned scheme 5, i.e., the predetermined value of pressure drop is reached in the sequence of prehydrotreating reactor C, prehydrotreating reactor B, and prehydrotreating reactor A.

In this example, raw material A is used in the prehydrotreating reactor A, prehydrotreating reactor B, and prehydrotreating reactor C, the total charged amount of catalyst, properties of feed material, and material feed rate are the same for the prehydrotreating reactor A, prehydrotreating reactor B, and prehydrotreating reactor C, the catalysts are charged into the prehydrotreating reactor A, prehydrotreating reactor B, prehydrotreating reactor C, and hydro-desulfurization reactor D with the methods shown in Table 3, the operating conditions are shown in Table 5, and the reaction results are shown in Table 7.

Example 2

In this example, the switching operation is performed with the above-mentioned scheme 5, i.e., the predetermined value of pressure drop is reached in the sequence of prehydrotreating reactor C, prehydrotreating reactor B, and prehydrotreating reactor A.

In this example, raw material B is used in the prehydrotreating reactor A, prehydrotreating reactor B, and prehydrotreating reactor C, the properties of the raw material B are shown in Table 1, and the liquid hour space velocities (LHSV) of material feeding to the reactors are different from each other, specifically, the LHSV of the prehydrotreating reactor A is 0.2 $h^{-1}$, the LHSV of the prehydrotreating reactor B is 0.32 $h^{-1}$, and the LHSV of the prehydrotreating reactor C is 0.44 $h^{-1}$. Catalysts are charged into the prehydrotreating reactor A, prehydrotreating reactor B, and prehydrotreating reactor C in the same way as shown in Table 3, the operating conditions of the reactors are shown in Table 5, and the reaction results are shown in Table 7.

Example 3

In this example, the switching operation is performed with the above-mentioned scheme 1, i.e., the predetermined value of pressure drop is reached in the sequence of prehydrotreating reactor A, prehydrotreating reactor B, and prehydrotreating reactor C.

In this example, raw material A is used in the prehydrotreating reactor A, raw material B is used in the prehydrotreating reactor B, and raw material C is used in the prehydrotreating reactor C, the properties of the raw materials are shown in Table 1. The feed rates of the prehydrotreating reactor A, prehydrotreating reactor B, and prehydrotreating reactor C are the same, catalysts are charged into the prehydrotreating reactor A, prehydrotreating reactor B, and prehydrotreating reactor C in the same way as shown in Table 3, the operating conditions of the reactors are shown in Table 5, and the reaction results are shown in Table 7.

Example 4

In this example, the switching operation is performed with the above-mentioned scheme 5, i.e., the predetermined value of pressure drop is reached in the sequence of prehydrotreating reactor C, prehydrotreating reactor B, and prehydrotreating reactor A.

In this example, raw material C is used in the prehydrotreating reactor A, prehydrotreating reactor B, and prehydrotreating reactor C, and the feed rates are the same. The average reaction temperature in the prehydrotreating reactor A is 365° C., the average reaction temperature in the prehydrotreating reactor B is 375° C., the average reaction temperature in the prehydrotreating reactor C is 385° C., the average reaction temperature in the hydro-desulfurization reactor D is 383° C., the catalyst charging method is shown in Table 3, the operating conditions are shown in Table 5, and the reaction results are shown in Table 7.

Comparative Examples

In the following comparative examples 1-4, a conventional serial process is used, and other aspects are the same as those of the examples 1-4.

Comparative Example 1

4 reactors are also employed in this Comparative example, i.e., reactor A, reactor B, reactor C, and reactor D, which are connected in series successively. Material A is used in this Comparative example, the properties of the raw material A are shown in Table 1, the feed rate and properties of feed material of the reactor A are the same as the overall feed rate and the properties of the feed material. The total charge amounts of the catalysts in the reactor A, reactor B, reactor C, and reactor D are the same as those in the prehydrotreating reactor A, prehydrotreating reactor B, prehydrotreating reactor C, and hydro-desulfurization reactor D in the example 1, but the charge amounts of different catalysts are different from each other, the catalysts are charged with the methods shown in Table 4, the operating conditions are shown in Table 6, and the reaction results are shown in Table 7.

Comparative Example 2

4 reactors are also employed in this Comparative example, i.e., reactor A, reactor B, reactor C, and reactor D, which are connected in series successively. Raw material B is used in this Comparative example, the properties of the raw material B are shown in Table 1, the total feed amount and the properties of feed material at the inlet of the reactor A are the same as those in the example 2. The total charge amounts of the catalysts in the reactor A, reactor B, reactor C, and reactor D are the same as those in the corresponding prehydrotreating reactor A, prehydrotreating reactor B, prehydrotreating reactor C, and hydro-desulfurization reactor D in the example 2, but the charge amounts of different catalysts are different from each other, the catalysts are charged with the methods shown in Table 4, the operating conditions are shown in Table 6, and the reaction results are shown in Table 7.

Comparative Example 3

4 reactors are also employed in this Comparative example, i.e., reactor A, reactor B, reactor C, and reactor D, which are connected in series successively. In this Comparative example, a raw material mixed from raw material A, raw material B and raw material C in the same proportion is used, the total feed amount and the properties of the mixed feed material at the inlet of the reactor A are the same as those in the example 3. The total charge amounts of the catalysts in the reactor A, reactor B, reactor C, and reactor D are the same as those in the corresponding prehydrotreating reactor A, prehydrotreating reactor B, prehydrotreating reactor C, and hydro-desulfurization reactor D in the example 3, but the charge amounts of different catalysts are different from each other, the catalysts are charged with the methods shown in Table 4, the operating conditions are shown in Table 6, and the reaction results are shown in Table 7.

Comparative Example 4

4 reactors are also employed in this Comparative example, i.e., reactor A, reactor B, reactor C, and reactor D, which are connected in series successively. Raw material C is used in this Comparative example, the properties of the raw material C are shown in Table 1, the total feed amount and the properties of feed material at the inlet of the reactor A are the same as those in the example 4. The total charge amounts of the catalysts in the reactor A, reactor B, reactor C, and reactor D are the same as those in the corresponding prehydrotreating reactor A, prehydrotreating reactor B, prehydrotreating reactor C, and hydro-desulfurization reactor D in the example 4, but the charge amounts of different catalysts are different from each other, the catalysts are charged with the methods shown in Table 4, the operating conditions are shown in Table 6, and the reaction results are shown in Table 7.

TABLE 1

Properties of Raw Materials

| Item | Raw Material A | Raw Material B | Raw Material C |
|---|---|---|---|
| S, wt % | 3.32 | 2.86 | 2.35 |
| N, μg/g | 3,566 | 3,320 | 4,200 |
| Residual carbon (CCR), wt % | 13.50 | 12.62 | 11.46 |
| Density (20° C.), kg/m$^3$ | 987.6 | 984.0 | 976.5 |
| Viscosity (100° C.), mm$^2$/s | 130.0 | 112.0 | 69.0 |
| Ni + V, μg/g | 105.0 | 82.0 | 63.0 |
| Fe, μg/g | 8 | 5 | 10 |
| Ca, μg/g | 5 | 5 | 3 |

TABLE 2

Main Physical and Chemical Properties of Catalysts

| | Designation of Catalyst | | | | | | |
|---|---|---|---|---|---|---|---|
| | FZC-100B | FZC-12B | FZC-13B | FZC-28A | FZC-204A | FZC-34B | FZC-41B |
| Type of Catalyst | Protectant | Protectant | Protectant | Demetallizing agent | Demetallizing agent | Desulfurizing agent | Residual carbon remover |
| Particle shape | Four-blade wheel | Four-blade wheel | Four-leaf clover | Four-leaf clover | Four-leaf clover | Four-leaf clover | Four-leaf clover |
| Particle diameter/mm | 6.0-8.0 | 3.2-4.2 | 1.5-1.8 | 1.3-1.6 | 1.1-1.6 | 1.0-1.6 | 1.0-1.6 |
| Strength/N (mm)$^{-1}$ | ≥10.0 | ≥8.0 | ≥8.0 | ≥10.0 | ≥12.0 | ≥12.0 | ≥12.0 |
| Packing density/kg · m$^{-3}$ | 700 | 410 | 410 | 460 | 480 | 540 | 595 |
| Specific surface area/m$^2$ · g$^{-1}$ | — | 100-150 | 100-150 | 110-145 | 135-185 | 140-180 | 160-200 |
| Pore volume/cm3 · g$^{-1}$ | ≥0.30 | ≥0.75 | ≥0.75 | ≥0.80 | ≥0.55 | ≥0.48 | ≥0.42 |
| Wear rate, m % | ≤2.0 | ≤2.0 | ≤2.0 | ≤2.0 | ≤2.0 | ≤1.5 | ≤1.5 |
| Chemical composition | Mo—Ni | Mo—Ni | Mo—Ni | Mo—Ni | Mo—Ni | Mo—Ni | Mo—Ni |

TABLE 3

Catalyst Packing Methods in Examples 1-4

| | Reactor A | Reactor B | Reactor C | Reactor D |
|---|---|---|---|---|
| Example 1 | FZC-100B:FZC-12B:FZC-13B:FZC-28A = 1:5:2:2 Average packing density = 410 kg/m$^3$ | FZC-12B:FZC-13B:FZC-28A = 2:4:4 Average packing density = 465 kg/m$^3$ | FZC-13B:FZC-28A:FZC-204A: =2:3:5 Average packing density = 522 kg/m$^3$ | FZC-34B:FZC-41B = 3:7 Average packing density = 605 kg/m$^3$ |
| Example 2 | FZC-100B:FZC-12B:FZC-13B:FZC-28A = 1:1:3:5 | FZC-100B:FZC-12B:FZC-13B:FZC-28A = 1:1:3:5 | FZC-100B:FZC-12B:FZC-13B:FZC-28A = 1:1:3:5 | FZC-34B:FZC-41B = 3:7 |
| Example 3 | FZC-100B:FZC-12B:FZC-13B:FZC-28A:FZC-204A = 1:1:3:3:2 | FZC-100B:FZC-12B:FZC-13B:FZC-204A = 1:1:3:3:2 | FZC-100B:FZC-12B:FZC-13B:FZC-204A = 1:1:3:3:2 | FZC-34B:FZC-41B = 3:7 |
| Example 4 | FZC-100B:FZC-12B:FZC-13B:FZC-28A = 1:1:3:5 | FZC-100B:FZC-12B:FZC-13B:FZC-28A = 1:1:3:5 | FZC-100B:FZC-12B:FZC-13B:FZC-28A = 1:1:3:5 | FZC-34B:FZC-41B = 3:7 |

TABLE 4

Catalyst Packing Methods in Comparative Examples 1-4

| | Reactor A | Reactor B | Reactor C | Reactor D |
|---|---|---|---|---|
| Comparative example 1 | FZC-100B:FZC-12B:FZC-13B = 1:7:2 Average packing density = 403 kg/m$^3$ | FZC-13B:FZC-28A = 5:5 Average packing density = 460 kg/m$^3$ | FZC-28A:FZC-204A = 5:5 Average packing density = 487 kg/m$^3$ | FZC-34B:FZC-41B = 4:6 Average packing density = 605 kg/m$^3$ |
| Comparative example 2 | FZC-100B:FZC-12B:FZC-13B = 3:3:4 | FZC-13B:FZC-28A = 5:5 | FZC-28A = 10 | FZC-34B:FZC-41B = 3:7 |
| Comparative example 3 | FZC-100B:FZC-12B:FZC-13B = 3:3:4 | FZC-13B:FZC-28A = 5:5 | FZC-28A FZC-204A = 4:6 | FZC-34B:FZC-41B = 3:7 |
| Comparative example 4 | FZC-100B:FZC-12B:FZC-13B = 3:3:4 | FZC-13B:FZC-28A = 5:5 | FZC-28A = 10 | FZC-34B:FZC-41B = 3:7 |

TABLE 5

Reaction Conditions in examples 1-4

| | Example 1 | Example 2 | Example 3 | Example 4 |
|---|---|---|---|---|
| Prehydrotreating reactor A | | | | |
| Reaction pressure, MPa | 16.0 | 16.0 | 16.0 | 16.0 |
| LHSV, h$^{-1}$ | 0.32 | 0.20 | 0.32 | 0.32 |
| Volume ratio of hydrogen to oil | 650 | 650 | 650 | 650 |
| Reaction temperature, ° C. | 380 | 380 | 380 | 365 |
| Prehydrotreating reactor B | | | | |
| Reaction pressure, MPa | 16.0 | 16.0 | 16.0 | 16.0 |
| LHSV, h$^{-1}$ | 0.32 | 0.32 | 0.32 | 0.32 |
| Volume ratio of hydrogen to oil | 650 | 650 | 650 | 650 |
| Reaction temperature, ° C. | 380 | 380 | 380 | 375 |
| Prehydrotreating reactor C | | | | |
| Reaction pressure, MPa | 16.0 | 16.0 | 16.0 | 16.0 |
| LHSV, h$^{-1}$ | 0.32 | 0.44 | 0.32 | 0.32 |
| Volume ratio of hydrogen to oil | 650 | 650 | 650 | 650 |
| Reaction temperature, ° C. | 380 | 380 | 380 | 385 |
| Hydro-desulfurization reactor D | | | | |
| Reaction pressure, MPa | 16.0 | 16.0 | 16.0 | 16.0 |
| LHSV, h$^{-1}$ | 0.53 | 0.53 | 0.53 | 0.53 |
| Volume ratio of hydrogen to oil | 650 | 650 | 650 | 650 |
| Reaction temperature, ° C. | 380 | 385 | 380 | 383 |

Note:

The maximum design value (i.e., design upper limit) of pressure drop for all reactors is 0.7 MPa.

TABLE 6

Reaction Conditions in Comparative Examples 1-4

| Name | Comparative example 1 | Comparative example 2 | Comparative example 3 | Comparative example 4 |
|---|---|---|---|---|
| Reactor A | | | | |
| Reaction pressure, MPa | 16.0 | 16.0 | 16.0 | 16.0 |
| LHSV, h$^{-1}$ | 0.96 | 0.96 | 0.96 | 0.96 |
| Volume ratio of hydrogen to oil | 650 | 650 | 650 | 650 |
| Reaction temperature, ° C. | 370 | 365 | 370 | 370 |
| Reactor B | | | | |
| Reaction pressure, MPa | 16.0 | 16.0 | 16.0 | 16.0 |
| LHSV, h$^{-1}$ | 0.96 | 0.96 | 0.96 | 0.96 |
| Volume ratio of hydrogen to oil | 650 | 650 | 650 | 650 |
| Reaction temperature, ° C. | 376 | 372 | 376 | 375 |
| Reactor C | | | | |
| Reaction pressure, MPa | 16.0 | 16.0 | 16.0 | 16.0 |
| LHSV, h$^{-1}$ | 0.96 | 0.96 | 0.96 | 0.96 |
| Volume ratio of hydrogen to oil | 650 | 650 | 650 | 650 |
| Reaction temperature, ° C. | 380 | 377 | 380 | 380 |

TABLE 6-continued

| Reaction Conditions in Comparative Examples 1-4 | | | | |
|---|---|---|---|---|
| Name | Comparative example 1 | Comparative example 2 | Comparative example 3 | Comparative example 4 |
| Reactor D | | | | |
| Reaction pressure, MPa | 16.0 | 16.0 | 16.0 | 16.0 |
| LHSV, $h^{-1}$ | 0.53 | 0.53 | 0.53 | 0.53 |
| Volume ratio of hydrogen to oil | 650 | 650 | 650 | 650 |
| Reaction temperature, ° C. | 385 | 382 | 385 | 386 |

TABLE 7

| Stable Running Period and Properties of Oil Generated through Heavy Oil Hydrogenation | | | | |
|---|---|---|---|---|
| | Example 1 | Comparative example 1 | Example 2 | Comparative example 2 |
| Running period | 12,300 h, wherein, the pressure drop in the reactor C reaches 0.42 MPa in 6,800 h, i.e., 60% of design upper limit; the pressure drop in the reactor B reaches 0.52 MPa in 9,800 h, i.e., 74% of design upper limit; the apparatus is shut down at 12,300 h, the pressure drop in the reactor A reaches 0.7 MPa, i.e., the design upper limit. | The pressure drop in the reactor B reaches the design upper limit in 8,400 h, and the apparatus has to be shut down. | 11,300 h, wherein, the pressure drop in the reactor C reaches 0.40 MPa in 5,800 h, i.e., 57% of design upper limit; the pressure drop in the reactor B reaches 0.48 MPa in 8,700 h, i.e., 70% of design upper limit; the apparatus is shut down at 11,300 h, the pressure drop in the reactor A reaches 0.7 MPa, i.e., the design upper limit. | The pressure drop in the reactor B reaches the design upper limit in 8,200 h, and the apparatus has to be shut down. |
| Density (20° C.), $g/cm^3$ | 935.9 | 938.8 | 933 | 934 |
| S, wt % | 0.46 | 0.45 | 0.38 | 0.40 |
| N, $\mu g \cdot g^{-1}$ | 1473 | 1580 | 1560 | 1634 |
| CCR, wt % | 5.80 | 5.60 | 5.40 | 5.84 |
| Ni + V, $\mu g \cdot g^{-1}$ | 13.3 | 14.6 | 15 | 13 |
| | Example 3 | Comparative example 3 | Example 4 | Comparative example 4 |
| Running period | 11,600 h, wherein, the pressure drop in the reactor A reaches 0.47 MPa in 6,820 h, i.e., 67% of design upper limit; The pressure drop in the reactor B reaches 0.52 MPa in 9,432 h, i.e., 74% of design upper limit; the pressure drops in the reactors A, B and C are 0.52 MPa, 0.60 MPa, and 0.70 MPa respectively before the apparatus is shut down finally. | The pressure drop in the reactor B reaches the design upper limit in 8,330 h, and the apparatus has to be shut down. | 15,200 h, wherein, the pressure drop in the reactor C reaches 0.50 MPa in 7,800 h, i.e., 71% of design upper limit; The pressure drop in the reactor B reaches 0.55 MPa in 11,300 h, i.e., 78% of design upper limit; the pressure drops in the reactors A, B and C are 0.70 MPa, 0.65 MPa, and 0.59 MPa respectively before the apparatus is shut down finally. | The pressure drop in the reactor B reaches the design upper limit in 9,800 h, and the apparatus has to be shut down. |
| Density (20° C.), $g/cm^3$ | 933 | 930 | 928 | 929 |
| S, wt % | 0.46 | 0.43 | 0.39 | 0.37 |
| N, $\mu g \cdot g^{-1}$ | 2130 | 2043 | 1930 | 2037 |
| CCR, wt % | 4.90 | 5.20 | 5.35 | 5.87 |
| Ni + V, $\mu g \cdot g^{-1}$ | 13.4 | 15.2 | 12.2 | 15.6 |

It is seen from the results in Table 7: the heavy oil hydrotreating method according to the present invention can greatly prolong the running period of a heavy oil hydrotreating apparatus.

Example 5

The reactors, raw material, charge amounts of catalysts and types of catalysts in the reactors, and reaction conditions in this example are the same as those in the example 1, but the switching operation scheme is different from the example 1, as follows:

When the pressure drop in the prehydrotreating reactor C reaches the predetermined value, the prehydrotreating reaction zone (including prehydrotreating reactor A and prehydrotreating reactor B), the prehydrotreating reactor C, and the hydro-desulfurization reaction zone are connected in series, by virtue of the regulation and control exercised by the control unit;

When the pressure drop in the prehydrotreating reactor B reaches the predetermined value, the prehydrotreating reactor A, the prehydrotreating reactor C, the prehydrotreating reactor B, and the hydro-desulfurization reaction zone are connected in series, by virtue of the regulation and control exercised by the control unit;

When the pressure drop in the prehydrotreating reactor C reaches the design upper value, the entire reaction system should be shut down. Please see Table 8 for the reaction result.

Example 6

The reactors, raw material, charge amounts of catalysts and types of catalysts in the reactors, and reaction conditions in this example are the same as those in the example 1, but the switching operation scheme is different from the example 1, as follows:

When the pressure drop in the prehydrotreating reactor C reaches the predetermined value, the prehydrotreating reaction zone (including prehydrotreating reactor A and prehydrotreating reactor B), the prehydrotreating reactor C, and the hydro-desulfurization reaction zone are connected in series, by virtue of the regulation and control exercised by the control unit;

When the pressure drop in the prehydrotreating reactor B reaches the predetermined value, the prehydrotreating reactor A, the prehydrotreating reactor C/prehydrotreating reactor B, and the hydro-desulfurization reaction zone are connected in series, and the prehydrotreating reactor C and the prehydrotreating reactor B are connected in parallel, by virtue of the regulation and control exercised by the control unit;

When the pressure drop in the prehydrotreating reactor B reaches the design upper value, the entire reaction system should be shut down. Please see Table 8 for the reaction result.

TABLE 8

Stable Running Period and Properties of Oil Generated through Heavy Oil Hydrogenation

| | Example 1 | Example 5 | Example 6 |
|---|---|---|---|
| Running period | 12,300 h, wherein, the pressure drop in the reactor C reaches 0.42 MPa in 6,800 h, i.e., 60% of design upper limit; The pressure drop in the reactor B reaches 0.52 MPa in 9,800 h, i.e., 74% of design upper limit; the apparatus is shut down at 12,300 h, the pressure drop in the reactor A reaches 0.7 MPa, i.e., the design upper limit. | 10,500 h, wherein, the pressure drop in the reactor C reaches 0.42 MPa in 6,800 h, i.e., 60% of design upper limit; The pressure drop in the reactor B reaches 0.52 MPa in 9,800 h, i.e., 74% of design upper limit; the apparatus is shut down at 10,500 h, the pressure drop in the reactor C reaches 0.7 MPa, i.e., the design upper limit. | 11,400 h, wherein, the pressure drop in the reactor C reaches 0.42 MPa in 6,800 h, i.e., 60% of design upper limit; The pressure drop in the reactor B reaches 0.52 MPa in 9,800 h, i.e., 74% of design upper limit; the apparatus is shut down at 11,400 h, the pressure drop in the reactor B reaches 0.7 MPa, i.e., the design upper limit. |
| Density (20° C.), $g/cm^3$ | 935.9 | 936.2 | 936.0 |
| S, wt % | 0.46 | 0.49 | 0.48 |
| N, $\mu g \cdot g^{-1}$ | 1473 | 1538 | 1492 |
| CCR, wt % | 5.80 | 5.85 | 5.81 |
| Ni + V, $\mu g \cdot g^{-1}$ | 13.3 | 16.0 | 14.2 |

It is seen from the results in Table 8: the switching operation scheme in the preferred example of the heavy oil hydrotreating method according to the present invention can further improve the stability of operation of the apparatus and prolong the running period of the heavy oil hydrotreating apparatus.

The invention claimed is:

1. A heavy oil hydrotreating method, comprising:

mixing a heavy oil raw material with hydrogen to form a feedstock;

monitoring a pressure drop in each prehydrotreating reactor among a plurality of prehydrotreating reactors, wherein a number of the plurality of prehydrotreating reactors is more than two;

connecting the plurality of prehydrotreating reactors in parallel to one another;

feeding the feedstock mixture into each of the plurality of prehydrotreating reactors connected in parallel;

when a pressure drop of a first among the plurality of prehydrotreating reactors reaches or exceeds a predetermined value, wherein the predetermined value is 50%-80% of a design upper limit of pressure drop for the first among the plurality of prehydrotreating reactors, determining the first among the plurality of prehydrotreating reactors to be a first spent reactor and fluidly connecting the inlet of the first spent reactor serially to an outlet of a remainder of the plurality of prehydrotreating reactors so that an effluent from the outlet feeds into the inlet of the first spent reactor;

feeding an effluent from the first spent reactor to one or more hydrotreating reactors;

when a pressure drop of a second among the plurality of prehydrotreating reactors reaches or exceeds a predetermined value, wherein the predetermined value is 50%-80% of a design upper limit of pressure drop for the second among the plurality of prehydrotreating reactors, determining the second among the plurality of prehydrotreating reactors to be a second spent reactor and fluidly connecting an inlet of the second spent reactor to an outlet of a third among the plurality of prehydrotreating reactors;

and shutting off the feedstock to all of the plurality of prehydrotreating reactors when at least one of the plurality of prehydrotreating reactors reach the design upper limit of the pressure drop.

2. The method according to claim 1, wherein the number of the plurality of prehydrotreating reactors is 3-6.

3. The method according to claim 1, further comprising controlling one or more parameters of the plurality of prehydrotreating reactors so that all the plurality of prehydrotreating reactors become spent reactors sequentially.

4. The method according to claim 3, wherein the one or more parameters of the plurality of prehydrotreating reactors is chosen from catalyst packing height in each prehydrotreating reactor, a feed rate of the feedstock into each prehydrotreating reactor, an operating temperature, a volumetric space velocity of the feedstock, or a catalyst packing density.

5. The method according to claim 4, wherein a maximum packing density is 400 $kgm^3$-600 $kg/m^3$ and a minimum packing density is 300 $kg/m^3$-550 $kg/m^3$.

6. The method according to claim 4, wherein a ratio of volumetric space velocities of the feedstock to two among the plurality of prehydrotreating reactors is 1.1-3:1.

7. The method according to claim 4, wherein a difference between metal contents in the feedstock in two prehydrotreating reactors is 5-50 μg/g.

8. The method according to claim 4, wherein a difference in operating temperatures in two among the plurality of prehydrotreating reactors is 2-30° C., or a difference in volumetric space velocities in two among the plurality of prehydrotreating reactors is 0.1-10 $h^{-1}$.

9. The method according to claim 1, wherein a hydrogenation protectant, a hydro-demetalization catalyst, and an optional hydro-desulfurization catalyst are disposed in each prehydrotreating reactor in sequence in a direction from an inlet to an outlet of the prehydrotreating reactor; and a hydro-desulfurization catalyst and a hydro-denitrogenation residual carbon conversion catalyst are disposed in the hydrotreating reactor in sequence.

10. The method according to claim 1, wherein in the plurality of prehydrotreating reactors, an operating temperature is 370° C.-420° C., a pressure is 10 MPa-25 MPa, a volume ratio of hydrogen to oil is 300-1,500, and a liquid hour space velocity (LHSV) of raw oil is 0.15 $h^{-1}$-2 $h^{-1}$.

11. The method according to claim 1, wherein the one or more hydrotreating reactors are 1 to 5 hydrotreating reactors connected in series.

12. The method according to claim 1, wherein, in the one or more hydrotreating reactors, the operating temperature is 370° C.-430° C., a pressure is 10 MPa-25 MPa, a volume ratio of hydrogen to oil 300-1,500, and a liquid hour space velocity (LHSV) of raw oil is 0.15 $h^{-1}$-0.8 $h^{-1}$.

13. The method according to claim 1, wherein the heavy oil is an atmospheric heavy oil, a vacuum residual oil, or a mixture thereof; or, the heavy oil comprises at least one of a straight run wax oil, a vacuum wax oil, a secondary processed wax oil, and a catalytic recycle oil.

* * * * *